US006942605B1

(12) United States Patent
Sukhovitsky

(10) Patent No.: US 6,942,605 B1
(45) Date of Patent: Sep. 13, 2005

(54) EXERCISE EQUIPMENT

(76) Inventor: Feliks Sukhovitsky, 61 Chester St. #1, Daly City, CA (US) 94014

( * ) Notice: Subject to any disclaimer, the term of this patent is extended or adjusted under 35 U.S.C. 154(b) by 0 days.

(21) Appl. No.: 10/731,585

(22) Filed: Dec. 9, 2003

(51) Int. Cl.[7] ..... A63B 21/00

(52) U.S. Cl. ..... 482/132; 482/79; 482/44; 482/148; 36/83; 280/12; 280/87; 2/24; 66/178 R

(58) Field of Search ..... 482/132, 79, 80, 482/44, 121, 148; 36/83; 280/12, 87; 2/24; 66/178 R

(56) References Cited

U.S. PATENT DOCUMENTS

| | | | | | |
|---|---|---|---|---|---|
| 1,090,446 | A | * | 3/1914 | Boynton | 2/24 |
| 1,547,166 | A | * | 7/1925 | Davidson | 2/24 |
| D129,175 | S | | 8/1941 | McCandish | |
| 2,318,059 | A | * | 5/1943 | Cooper | 280/32.5 |
| 2,484,494 | A | * | 10/1949 | Ferguson | 2/24 |
| 2,819,081 | A | | 1/1958 | Touraine | |
| 3,784,192 | A | * | 1/1974 | Nutter | 482/132 |
| 3,809,393 | A | | 5/1974 | Jones | |
| 4,166,630 | A | * | 9/1979 | Sullivan et al. | 280/87.021 |
| 4,413,832 | A | * | 11/1983 | Pendleton | 280/845 |
| 4,623,158 | A | * | 11/1986 | Monreal | 280/11.12 |
| 4,700,945 | A | | 10/1987 | Rader | |
| 4,892,305 | A | | 1/1990 | Lynch | |
| 4,957,442 | A | * | 9/1990 | Prater | 434/166 |
| 5,027,802 | A | * | 7/1991 | Donohue | 602/22 |
| 5,742,939 | A | * | 4/1998 | Williams | 2/69 |
| 5,870,774 | A | * | 2/1999 | Legenstein | 2/24 |
| 5,987,778 | A | * | 11/1999 | Stoner | 36/1.5 |
| 5,993,362 | A | * | 11/1999 | Ghobadi | 482/124 |
| 6,219,845 | B1 | * | 4/2001 | Ferriter | 2/24 |
| 6,332,224 | B1 | * | 12/2001 | Walker et al. | 2/239 |
| 6,729,164 | B2 | * | 5/2004 | Shibata | 65/178 R |
| 2004/0087416 | A1 | * | 5/2004 | Trenary | |
| 2004/0108074 | A1 | * | 6/2004 | Marchetti | |

* cited by examiner

*Primary Examiner*—Stephen R. Crow
*Assistant Examiner*—L. Amerson

(57) ABSTRACT

Exercise equipment toning and strengthening the muscles of the abdomen, back, shoulders, arms, and legs. A plurality of hand attachments, elbow attachments, knee attachments, and foot attachments are provided which allow the user to exercise their whole body. The bottom of the hand attachments, elbow attachments, knee attachments, and foot attachments have caster wheels attached so that they can roll on a variety of surfaces. The hand attachments and elbow attachments are combined to form gloves and the knee attachments and foot attachments are combined to form boots. Pads are provided on the top of the hand attachments, elbow attachments, and knee attachments to cushion the user.

5 Claims, 8 Drawing Sheets

EXERCISE EQUIPMENT

BACKGROUND OF THE INVENTION

1. Field of the Invention

The present invention relates to exercise equipment for use in connection with physical conditioning. The exercise equipment has particular utility in connection with toning and strengthening the muscles of the abdomen, back, shoulders, arms, and legs.

2. Description of the Prior Art

Exercise equipment is desirable for toning and strengthening the muscles of the abdomen, back, shoulders, arms, and legs. Physical fitness is widely recognized as a key component to good health. Experts recommend at least 30 minutes of daily exercise for maximum health benefits. Exercise equipment provides the user with a whole body workout without requiring a great deal of expense or a large amount of room. The user can adjust the exercises they perform to adapt to their level of fitness. The exercise equipment is lightweight and compact, making it easy to transport for use when traveling.

The use of exercise apparatuses is known in the prior art. For example, U.S. Pat. No. 4,700,945 to Rader discloses an exercise apparatus. However, the Rader '945 patent does not have wheels on all units, and has further drawbacks of lacking shoes.

U.S. Pat. No. 4,892,305 to Lynch discloses an exercising device that supports a limb of a user on or against a supporting surface while permitting movement of the limb in any direction along the supporting surface. However, the Lynch '305 patent does not have a protruding hand pad.

Similarly, U.S. Pat. No. 3,809,393 to Jones discloses a swivel caster supported exercising handle apparatus that supports a weight portion of the user's body during movement thereof on a floor or other surface under the control of the user's upper body muscles. However, the Jones '393 patent does not have shoes, and cannot be attached to the user's elbows or knees.

In addition, U.S. Pat. No. 3,784,192 to Nutter discloses a wheel supported exercising device that supports the user's feet and ankles when the user is in the prone position. However, the Nutter '192 patent does not have a handle, and also does not have an elbow attachment.

Furthermore, U.S. Pat. No. 2,819,081 to Touraine discloses exercisers that exercise the upper extremity. However, the Touraine '081 patent does not attach to the user's elbows or knees, and further lacks shoes.

Lastly, U.S. Pat. No. Des. 129,175 to McCandlish discloses a roller skate that attaches to the user's foot. However, the McCandlish '175 patent does not have a handle, and has the additional deficiency of lacking caster-type wheels.

While the above-described devices fulfill their respective, particular objectives and requirements, the aforementioned patents do not describe exercise equipment that allows toning and strengthening the muscles of the abdomen, back, shoulders, arms, and legs. The Rader '945 patent makes no provision for wheels on all units. The Rader '945 patent, the Jones '393 patent, and the Touraine '081 patent lack shoes. The Lynch '305 patent, the Nutter '192 patent, and the McCandlish '175 patent do not have a handle. The Lynch '305 patent does not have a triangle-shaped hand attachment. The Jones '393 patent and the Touraine '081 patent cannot be attached to the user's elbows or knees, and the Nutter '192 patent does not have an elbow attachment. The McCandlish '175 patent lacks caster-type wheels.

Therefore, a need exists for new and improved exercise equipment that can be used for toning and strengthening the muscles of the abdomen, back, shoulders, arms, and legs. In this regard, the present invention substantially fulfills this need. In this respect, the exercise equipment according to the present invention substantially departs from the conventional concepts and designs of the prior art, and in doing so provides an apparatus primarily developed for the purpose of toning and strengthening the muscles of the abdomen, back, shoulders, arms, and legs.

SUMMARY OF THE INVENTION

In view of the foregoing disadvantages inherent in the known types of exercise apparatuses now present in the prior art, the present invention provides an improved exercise equipment, and overcomes the above-mentioned disadvantages and drawbacks of the prior art. As such, the general purpose of the present invention, which will be described subsequently in greater detail, is to provide a new and improved exercise equipment which has all the advantages of the prior art mentioned heretofore and many novel features that result in exercise equipment which is not anticipated, rendered obvious, suggested, or even implied by the prior art, either alone or in any combination thereof.

To attain this, the present invention essentially comprises a hand attachment, a foot attachment, an elbow attachment, and a knee attachment.

There has thus been outlined, rather broadly, the more important features of the invention in order that the detailed description thereof that follows may be better understood and in order that the present contribution to the art may be better appreciated.

The invention may also include a plurality of hand attachments, foot attachments, elbow attachments, and knee attachments. The hand attachment may comprise a hand base with a hand pad and a handle attached to its top and a wheel attached to its bottom. The foot attachment may comprise a shoe with a wheel attached to one end. The elbow attachment may comprise an elbow base with an elbow pad, one end of a first elbow strap, and one end of a second elbow strap attached to its top and a wheel attached to its bottom. The opposing end of the first elbow strap and the opposing end of the second elbow strap may be removably connected by a hook and loop fastener. The knee attachment may comprise a knee base with a knee pad, one end of a first knee strap, and one end of a second knee strap attached to its top, and a wheel attached to its bottom. The opposing end of the first knee strap and the opposing end of the second knee strap may be removably connected by a hook and loop fastener. The hand attachment and elbow attachment may be combined to comprise a glove with an elbow base attached to one end, a hand base attached to its opposing end, and a plurality of wheels attached to the bottom of the hand base and the elbow base. The knee attachment and the foot attachment may be combined to comprise a boot with a knee base attached to one end and a plurality of wheels attached to the bottom of the knee base and to the opposing end of the boot. The wheels may be of the caster type. The hand pad, elbow pad, and knee pad may be made of foam rubber. The hand base may be ovoid in shape, but other geometric shapes do not deviate from the spirit and scope of the invention. The hand base, elbow base, knee base, and shoe may be made of plastic, wood, aluminum, titanium, steel, or carbon fiber composite. The wheels may be replaced by a coating of a material having a low coefficient of static friction and a low coefficient of kinetic friction, such as polytetrafluoroethylene. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise equipment that has all of the advantages of the prior art exercise apparatuses and none of the disadvantages.

It is another object of the present invention to provide new and improved exercise equipment that may be easily and efficiently manufactured and marketed.

An even further object of the present invention is to provide new and improved exercise equipment that has a low cost of manufacture with regard to both materials and labor, and which accordingly is then susceptible of low prices of sale to the consuming public, thereby making such exercise equipment economically available to the buying public.

Still another object of the present invention is to provide new exercise equipment that provides in the apparatuses and methods of the prior art some of the advantages thereof, while simultaneously overcoming some of the disadvantages normally associated therewith.

Even still another object of the present invention is to provide exercise equipment for toning and strengthening the muscles of the abdomen, back, shoulders, arms, and legs. This allows the user to perform a variety of exercises.

Still yet another object of the present invention is to provide exercise equipment for toning and strengthening the muscles of the abdomen, back, shoulders, arms, and legs. This makes it possible to easily store and transport the exercise equipment.

An additional object of the present invention is to provide exercise equipment for toning and strengthening the muscles of the abdomen, back, shoulders, arms, and legs. This allows the exercise equipment to be used on a variety of surfaces.

A further object of the present invention is to provide exercise equipment for toning and strengthening the muscles of the abdomen, back, shoulders, arms, and legs. This allows the user to obtain a whole body workout.

Lastly, it is an object of the present invention to provide new and improved exercise equipment for toning and strengthening the muscles of the abdomen, back, shoulders, arms, and legs.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
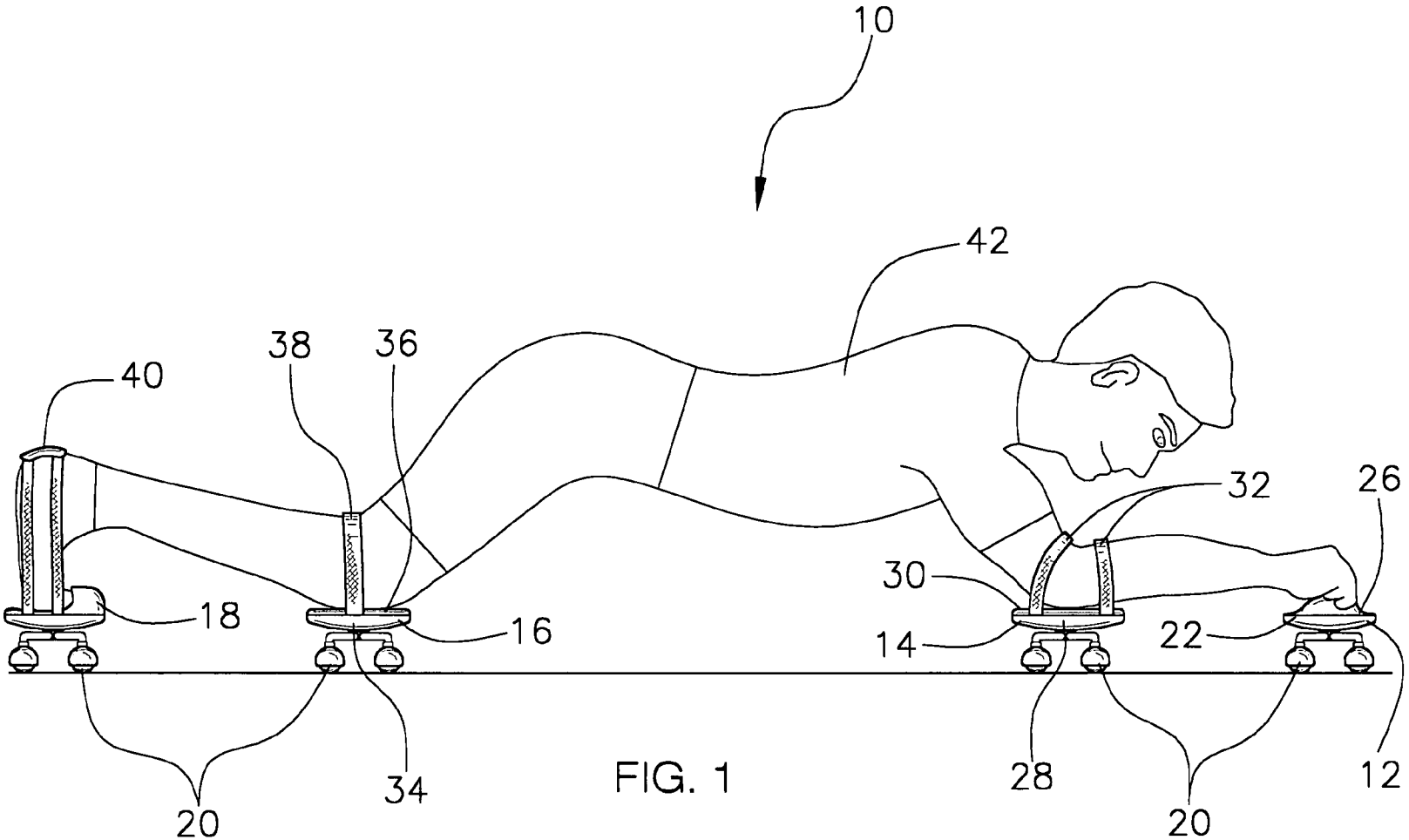
FIG. 1 is a right side view of the current embodiment of the exercise equipment constructed in accordance with the principles of the present invention.

Referring now to the drawings, and particularly to FIGS. 1–10, a current embodiment of the exercise equipment of the present invention is shown and generally designated by the reference numeral 10.

In FIG. 1, new and improved exercise equipment 10 of the present invention for toning and strengthening the muscles of the abdomen, back, shoulders, arms, and legs is illustrated and will be described. More particularly, the exercise equipment 10 has a hand attachment 12, elbow attachment 14, knee attachment 16, and foot attachment 18. The exercise equipment 10 is shown in use with the hand attachment 12, elbow attachment 14, knee attachment 16, and foot attachment 18 being utilized by user 42. Hand attachment 12 has a protruding hand pad 26 which also functions as a handle attached to the top of hand base 22 and caster wheels 20 attached to the bottom of hand base 22. Hand pad 26 allows the user 42 to grasp hand attachment 12, while hand pad 26 cushions the user 42. Elbow attachment 14 has one end of first elbow straps 32 and elbow pad 30 attached to the top of elbow base 28 and caster wheels 20 attached to the bottom of elbow base 28. First elbow straps 32 connect elbow attachment 14 to user 42, while elbow pad 30 cushions user 42. Knee attachment 16 has one end of first knee strap 38 and knee pad 36 attached to the top of knee base 34 and caster wheels 20 attached to the bottom of the base 34. First knee strap 38 connects knee attachment 16 to user 42, while knee pad 36 cushions user 42. Foot attachment 18 has a shoe 40 with a caster wheel 20 attached to one end. Shoe 40 connects foot attachment 18 to user 42. The caster wheels 20 allow the user 42 to move hand attachment 12, elbow attachment 14, knee attachment 16, and foot attachment 18 to exercise his or her body. In the current embodiment, hand pad 26, elbow pad 30, and knee pad 36 are made of foam rubber, and hand base 22, elbow base 28, knee base 34, and shoe 40 are made of plastic. Note that user 42 is for illustrative purposes only and is not part of the current invention.

Figure 2:
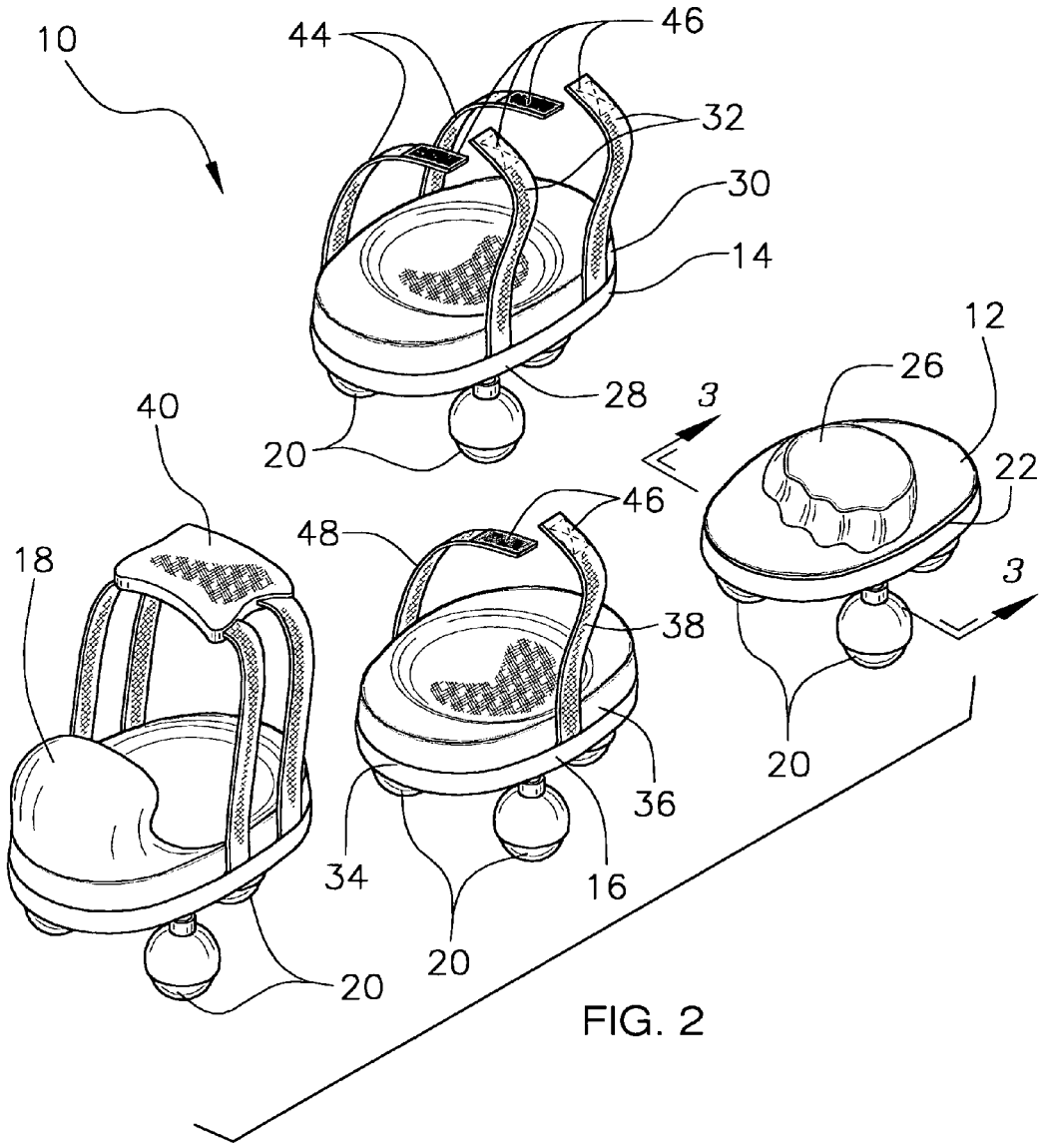
FIG. 2 is a top perspective view of the exercise equipment of the present invention.

Moving on to FIG. 2, new and improved exercise equipment 10 of the present invention for toning and strengthening the muscles of the abdomen, back, shoulders, arms, and legs is illustrated and will be described. More particularly, the exercise equipment 10 has a hand attachment 12, elbow attachment 14, knee attachment 16, and foot attachment 18. Hand attachment 12 has a hand base 22 with a hand pad 26 attached to its top and caster wheels 20 attached to its bottom. In the current embodiment, the caster wheels 20 attached to the bottom of hand base 22 are arranged in a triangular fashion. The elbow attachment 14 has an oval-shaped elbow base 28 with elbow pad 30, one end of first elbow straps 32, and one end of second elbow straps 44 attached to its top and caster wheels 20 attached to its bottom. In the current embodiment, the caster wheels 20 attached to the bottom of elbow base 28 are arranged in a triangular fashion. Hook and loop fasteners 46 removably attach the opposing end of second elbow straps 44 to the opposing end of first elbow straps 32 to removably secure the elbow attachment 14 to user 42 (not shown). Knee attachment 16 has an oval-shaped knee base 34 with knee pad 36, one end of first knee strap 38, and one end of second knee strap 48 attached to its top and caster wheels 20 attached to its bottom. In the current embodiment, the caster wheels 20 attached to the bottom of knee base 34 are arranged in a triangular fashion. Hook and loop fastener 46 removably attaches the opposing end of second knee strap 48 to the opposing end of first knee strap 38 to removably secure the knee attachment 16 to user 42. Foot attachment 18 has a shoe 40 with caster wheels 20 attached to one end. Caster wheels 20 are used so that the user can roll the hand attachment 12, elbow attachment 14, knee attachment 16, and foot attachment 18 in any direction.

Figure 3:
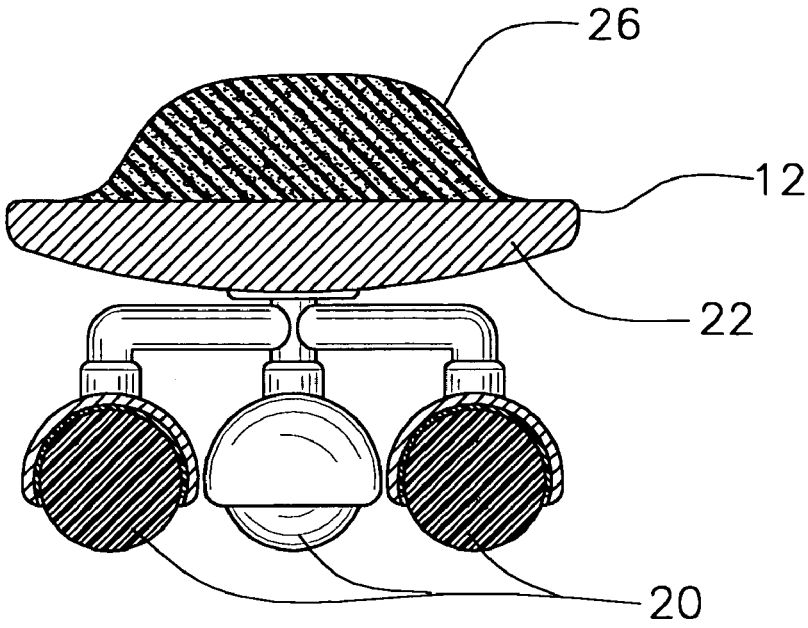
FIG. 3 is a side sectional view of the hand attachment of the present invention.

Continuing with FIG. 3, a new and improved hand attachment 12 of the present invention for toning and strengthening the muscles of the abdomen, back, shoulders, arms, and legs is illustrated and will be described. More particularly, the hand attachment 12 has a hand pad 26 attached to the top of hand base 22. Caster wheels 20 are attached to the bottom of hand base 22.

Figure 4:
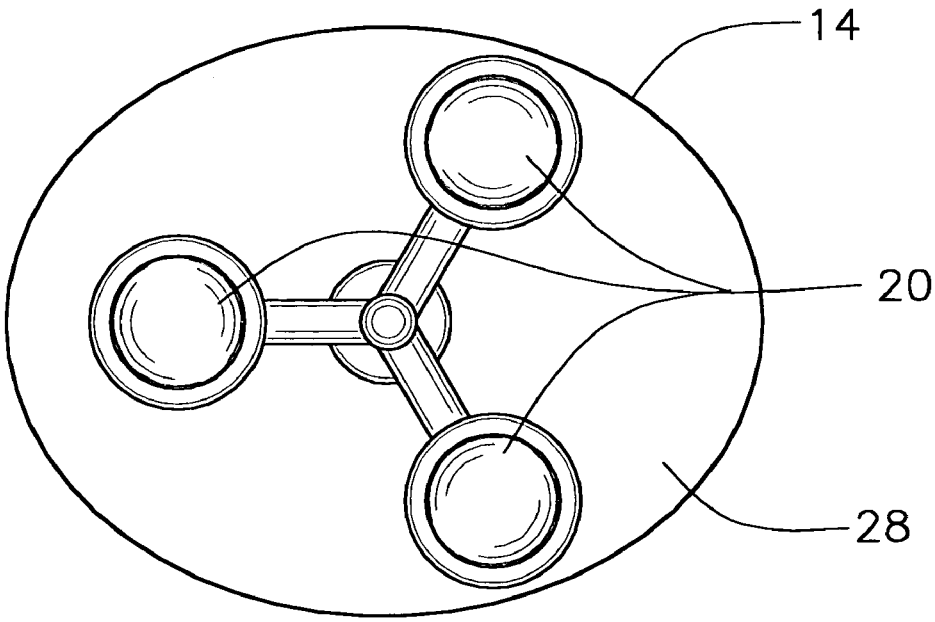
FIG. 4 is a bottom side view of an attachment of the present invention.

In addition, in FIG. 4, a new and improved elbow attachment 14 of the present invention for toning and strengthening the muscles of the abdomen, back, shoulders, arms, and legs is illustrated and will be described. More particularly, the elbow attachment 14 has caster wheels 20, arranged in a triangular fashion, attached to the bottom of elbow base 28.

Figure 5:
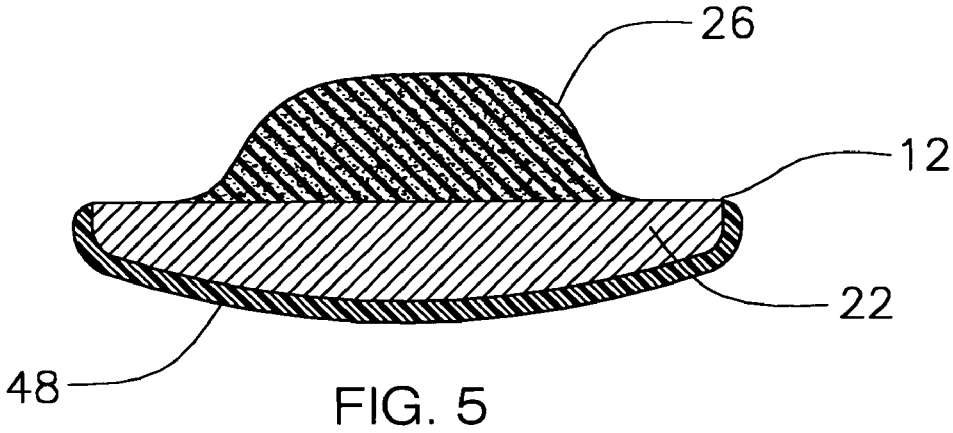
FIG. 5 is a side sectional view of an alternative embodiment of the hand attachment of the present invention.

Furthermore, in FIG. 5, an alternative embodiment of a new and improved hand attachment 12 of the present invention for toning and strengthening the muscles of the abdomen, back, shoulders, arms, and legs is illustrated and will be described. More particularly, the hand attachment 12 has a hand pad 26 attached to the top of hand base 22. A polytetrafluoroethylene coating 48 has been applied to the bottom of hand base 22. The polytetrafluoroethylene coating 48 provides the hand attachment 12 with low coefficients of static and kinetic friction, thereby allowing the hand attachment 12 to slide on a variety of surfaces. A polytetrafluoroethylene coating 48 can also be applied to the bottom of the elbow bases 28 (not shown), knee bases 34 (not shown), and foot attachments 18 (not shown) in lieu of caster wheels 20 (not shown).

Figure 6:
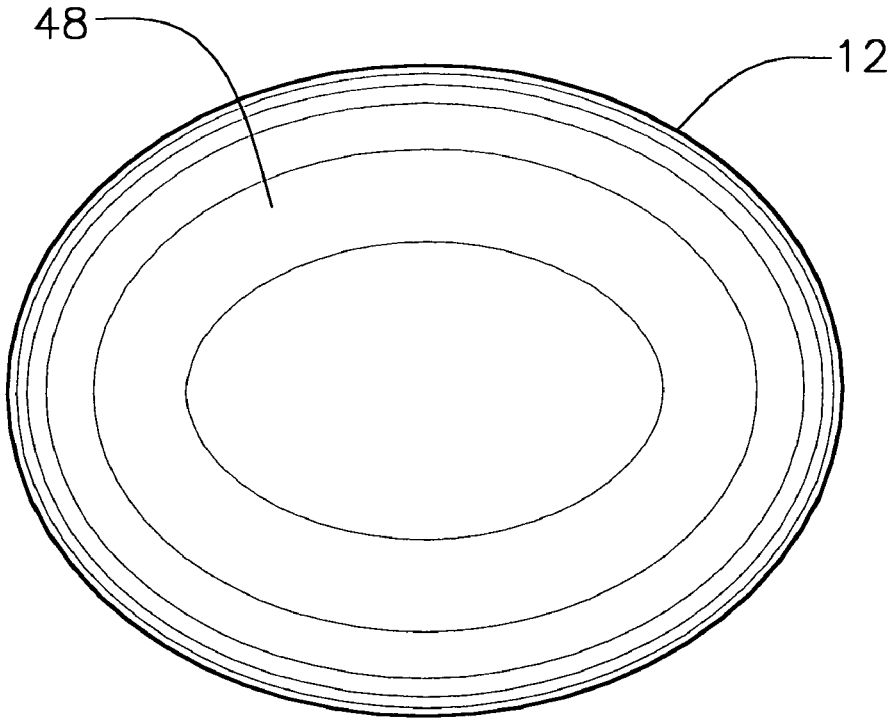
FIG. 6 is bottom side view of the alternative embodiment of the hand attachment of the present invention.

In FIG. 6, an alternative embodiment of a new and improved hand attachment 12 of the present invention for toning and strengthening the muscles of the abdomen, back, shoulders, arms, and legs is illustrated and will be described. More particularly, the hand attachment 12 has a polytetrafluoroethylene coating 48 applied to the bottom of the hand base 22 (not shown).

Figure 7:
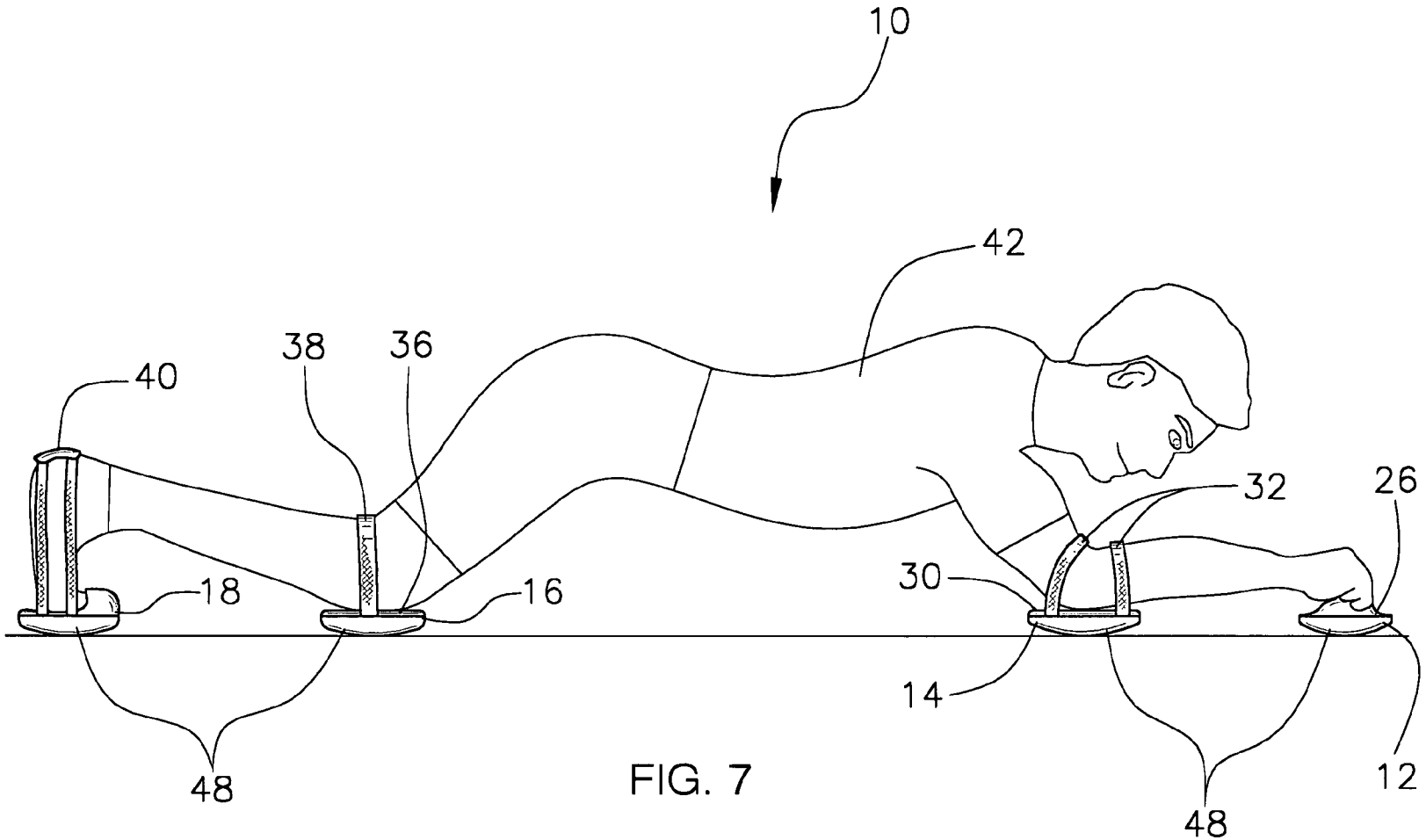
FIG. 7 is a right side view of the alternative embodiment of the exercise equipment of the present invention.

Moving on to FIG. 7, an alternative embodiment of the new and improved exercise equipment 10 of the present invention for toning and strengthening the muscles of the abdomen, back, shoulders, arms, and legs is illustrated and will be described. More particularly, the exercise equipment 10 has a hand attachment 12, elbow attachment 14, knee attachment 16, and foot attachment 18. The exercise equipment 10 is shown in use with the hand attachment 12, elbow attachment 14, knee attachment 16, and foot attachment 18 being utilized by user 42. Hand attachment 12 has an oval-shaped hand base 22 with a hand pad 26 attached to its top and a polytetrafluoroethylene coating 48 applied to its bottom. The elbow attachment 14 has an oval-shaped elbow base 28 with elbow pad 30, one end of first elbow straps 32, and one end of second elbow straps 44 attached to its top and a polytetrafluoroethylene coating 48 applied to its bottom. Hook and loop fasteners 46 removably attach the opposing end of second elbow straps 44 to the opposing end of first elbow straps 32 to removably secure the elbow attachment 14 to user 42 (not shown). Knee attachment 16 has an oval-shaped knee base 34 with knee pad 36, one end of first knee strap 38, and one end of second knee strap 48 attached to its top, and a polytetrafluoroethylene coating 48 applied to its bottom. Hook and loop fastener 46 removably attaches the opposing end of second knee strap 48 to the opposing end of first knee strap 38 to removably secure the knee attachment 16 to user 42. Foot attachment 18 has a shoe 40 with a polytetrafluoroethylene coating 48 applied to one end. The polytetrafluoroethylene coating 48 is used to reduce the coefficients of static and kinetic friction so that the user 42 can slide the hand attachment 12, elbow attachment 14, knee attachment 16, and foot attachment 18 in any direction. Note that user 42 is for illustrative purposes only and is not part of the current invention.

Figure 8:
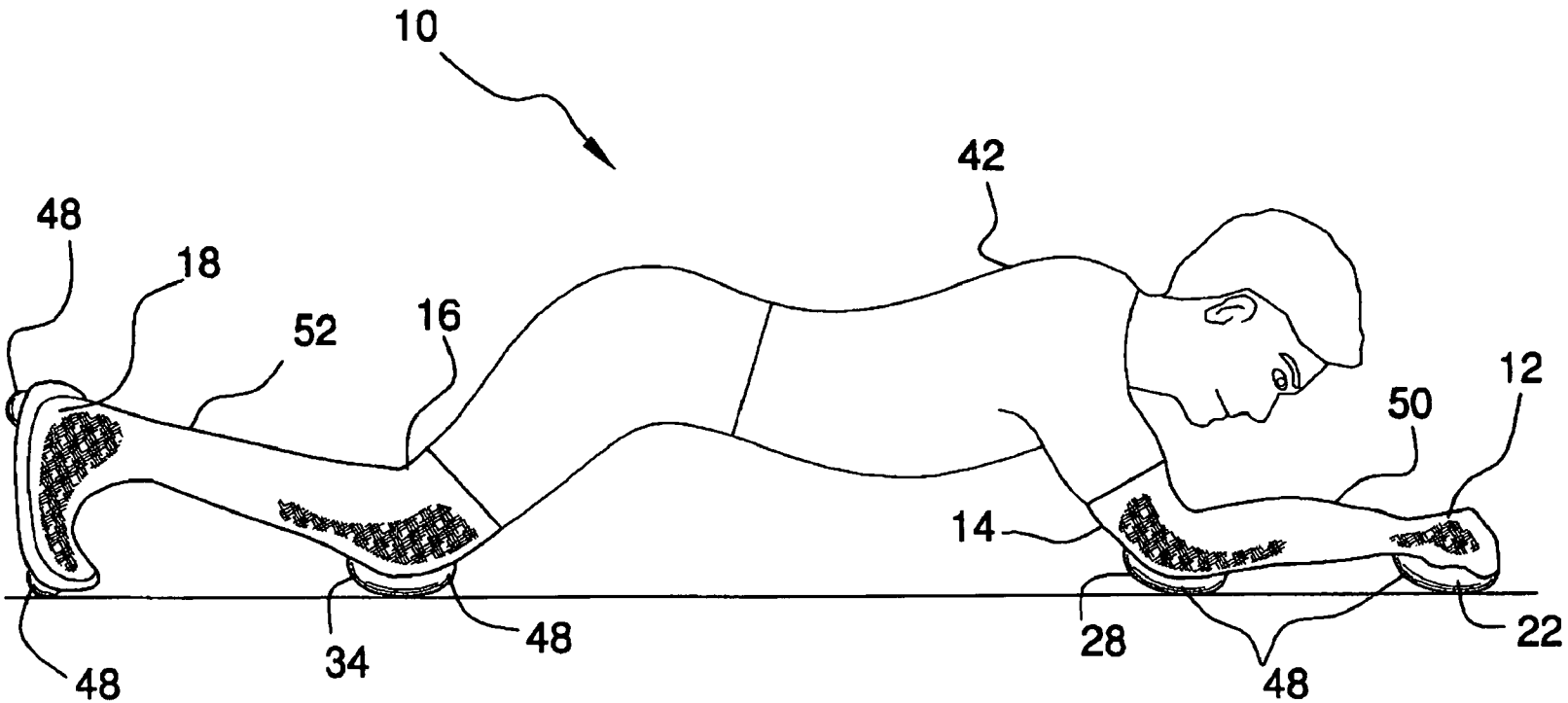
FIG. 8 is a right side view of a third embodiment of the exercise equipment of the present invention.

Continuing with FIG. 8, a third embodiment of the new and improved exercise equipment 10 of the present invention for toning and strengthening the muscles of the abdomen, back, shoulders, arms, and legs is illustrated and will be described. More particularly, the exercise equipment 10 has a hand attachment 12, elbow attachment 14, knee attachment 16, and foot attachment 18, but in this case, the hand attachment 12 and elbow attachment 14 are combined to form a glove 50, and the knee attachment 16 and foot attachment 18 are combined to form a boot 52. The exercise equipment 10 is shown in use with the hand attachment 12, elbow attachment 14, knee attachment 16, and foot attachment 18 being utilized by user 42. An oval-shaped hand base 22 with a polytetrafluoroethylene coating 48 applied to its bottom is connected to the hand attachment 12 portion of the glove 50. An oval-shaped elbow base 28 with a polytetrafluoroethylene coating 48 applied to its bottom is connected to the elbow attachment 14 portion of the glove 50. An oval-shaped knee base 34 with a polytetrafluoroethylene coating 48 applied to its bottom is connected to the knee attachment 16 portion of the boot 52. A polytetrafluoroethylene coating 48 is applied to one end of the foot attachment 18 portion of the boot 52. The polytetrafluoroethylene coating 48 is used to reduce the coefficients of static and kinetic friction so that the user 42 can slide the hand attachment 12, elbow attachment 14, knee attachment 16, and foot attachment 18 in any direction. Note that user 42 is for illustrative purposes only and is not part of the current invention.

Figure 9:
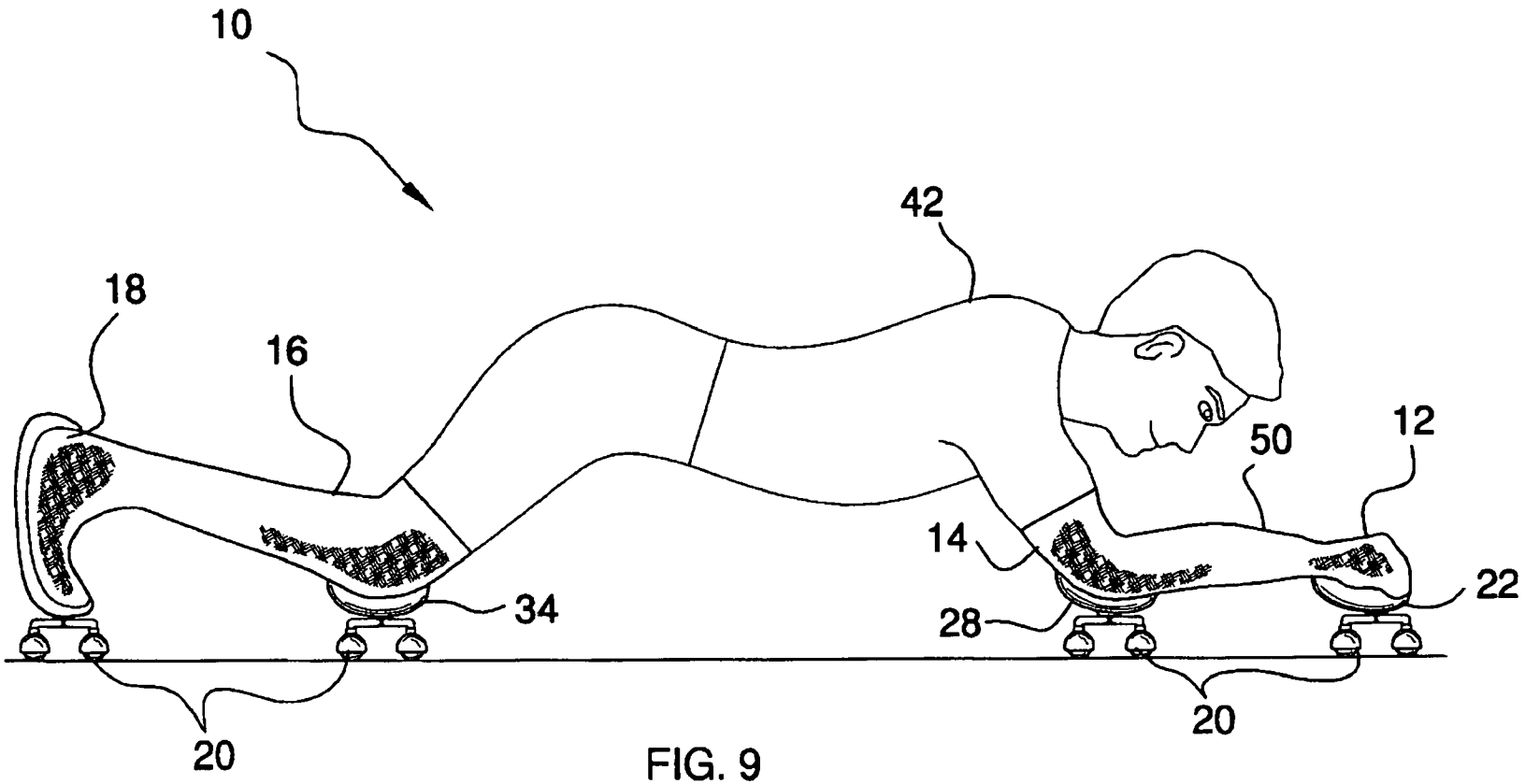
FIG. 9 is a right side view of a fourth embodiment of the exercise equipment of the present invention.

Furthermore, in FIG. 9, a fourth embodiment of the new and improved exercise equipment 10 of the present invention for toning and strengthening the muscles of the abdomen, back, shoulders, arms, and legs is illustrated and will be described. More particularly, the exercise equipment 10 has a hand attachment 12, elbow attachment 14, knee attachment 16, and foot attachment 18, but in this case, the hand attachment 12 and elbow attachment 14 are combined to form a glove 50, and the knee attachment 16 and foot attachment 18 are combined to form a boot 52. The exercise equipment 10 is shown in use with the hand attachment 12, elbow attachment 14, knee attachment 16, and foot attachment 18 being utilized by user 42. An oval-shaped hand base 22 with caster wheels 20 attached to its bottom is connected to the hand attachment 12 portion of the glove 50. An oval-shaped elbow base 28 with caster wheels 20 attached to its bottom is connected to the elbow attachment 14 portion of the glove 50. An oval-shaped knee base 34 with caster wheels 20 attached to its bottom is connected to the knee attachment 16 portion of the boot 52. Caster wheels 20 are also attached to one end of the foot attachment 18 portion of the boot 52. Caster wheels 20 are attached to the bottom of the hand base 22, elbow base 28, knee base 34, and one end of the foot attachment 18 portion of the boot 52 so that the user 42 can roll the hand attachment 12, elbow attachment 14, knee attachment 16, and foot attachment 18 in any direction. Note that user 42 is for illustrative purposes only and is not part of the current invention.

Figure 10:
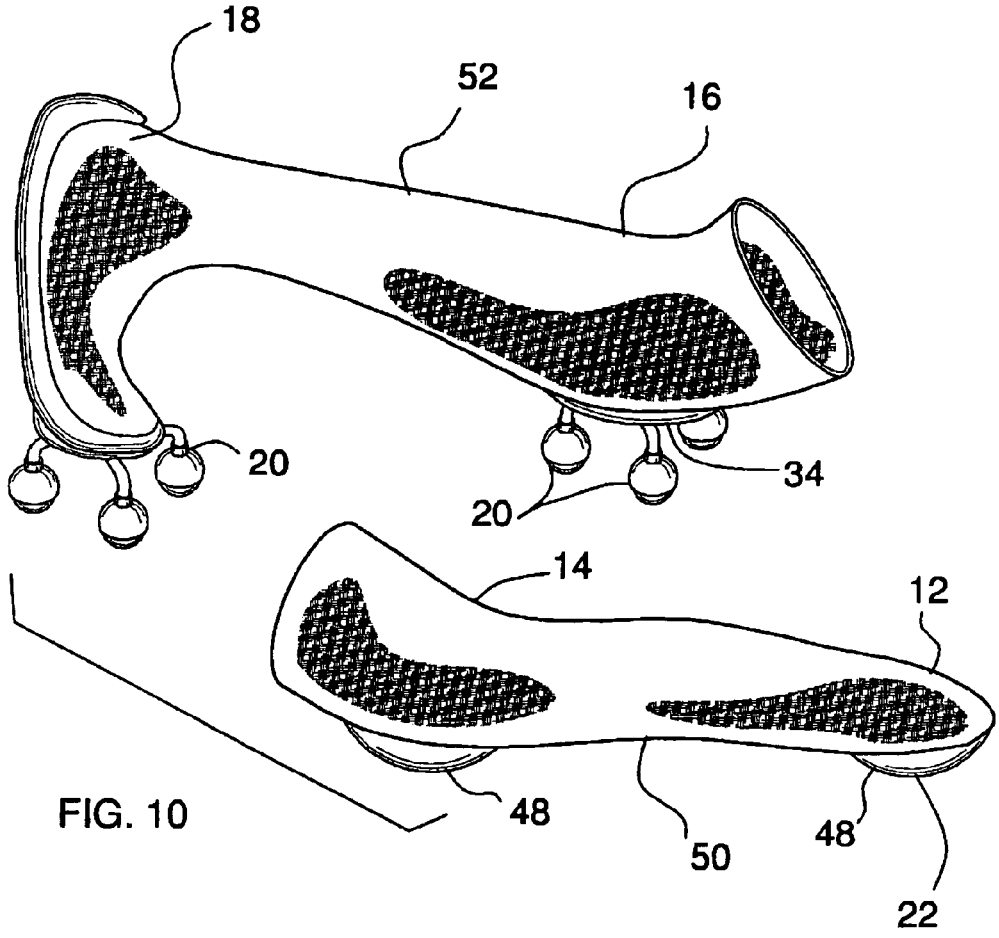
FIG. 10 is a top perspective view of the boot of the fourth embodiment of the exercise equipment of the present invention and the glove of the third embodiment of the exercise equipment of the present invention.

Concluding with FIG. 10, a boot 52 of the fourth embodiment of the exercise equipment 10 of the present invention and a glove 50 of the third embodiment of the exercise equipment 10 of the present invention for toning and strengthening the muscles of the abdomen, back, shoulders, arms, and legs are illustrated and will be described. More particularly, an oval-shaped knee base 34 with caster wheels 20 attached to its bottom is connected to the knee attachment 16 portion of the boot 52. Caster wheels 20 are also attached to one end of the foot attachment 18 portion of the boot 52. An oval-shaped hand base 22 with a polytetrafluoroethylene coating 48 applied to its bottom is connected to the hand attachment 12 portion of the glove 50. An oval-shaped elbow base 28 with a polytetrafluoroethylene coating 48 applied to its bottom is connected to the elbow attachment 14 portion of the glove 50.

In use, it can now be understood that the user 42 prepares to exercise by attaching the exercise equipment 10 to his or her limbs. In one embodiment, this is accomplished by using first elbow straps 32 and second elbow straps 44 to attach elbow attachments 14 to his elbows and first knee strap 38 and second knee strap 48 to attach knee attachments 16 to his knees. The user 42 then places his feet in shoes 40 to attach foot attachments 18 to his feet. Once the user has lain down on his belly, supporting his weight on elbow attachments 14, knee attachments 16, and foot attachments 18, he grasps the hand pad 26 of hand attachments 12, and is ready to begin exercising. In another embodiment, this is accomplished by inserting the legs into boots 52 and the arms into gloves 50. Once the user has lain down on his belly, supporting his weight on hand attachments 12, elbow attachments 14, knee attachments 16, and foot attachments 18, he is ready to begin exercising.

User 42 rolls or slides (depending upon the embodiment chosen) the hand attachments 12, elbow attachments 14, knee attachments 16, and foot attachments 18 in any desired direction to exercise his body. Upon the conclusion of the exercise session, the user 42 removes the exercise equipment 10. The exercise equipment 10 is now ready for storage.

While a current embodiment of the exercise equipment has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as steel, aluminum, titanium, wood, or carbon fiber composite may be used instead of the plastic hand base, elbow base, knee base, and shoe described, and a separate and distinct handle made of a material different than the hand pad can be used rather than integrating the handle into the hand pad. Also, the foam rubber hand pad, elbow pad, and knee pad may also be made of other foams or similarly resilient materials. Furthermore, a wide variety of caster wheel arrangements may be used instead.

I claim:

1. An exercise kit comprising: a glove having opposing ends comprising a hand attachment and an elbow attachment, an elbow base attached to one end of said glove, a hand base attached to said opposing end of said glove, and a plurality of wheels attached to the bottom of said hand base and said elbow base; a boot having opposing ends comprising a knee attachment and a foot attachment, a knee base attached to one end of said boot and a foot base attached to an opposing end of said boot and a plurality of wheels attached to the bottom of said knee base and said foot base.

2. The exercise kit as defined in claim 1 wherein said wheels are casters.

3. The exercise kit as defined in claim 1 further comprising: a hand pad attached to the top of said hand base; an elbow pad attached to the top of said elbow base; and a knee pad attached to the top of said knee base.

4. The exercise equipment as defined in claim 3, wherein said hand pads, said elbow pads, and said knee pads are made of foam rubber.

5. The exercise kit as defined in claim 1 wherein said hand base, said elbow base, said foot base and said knee base are selected from the group consisting of plastic, steel, aluminum, titanium, wood, and carbon fiber composite.

* * * * *